US006198829B1

(12) United States Patent
Fink et al.

(10) Patent No.: US 6,198,829 B1
(45) Date of Patent: Mar. 6, 2001

(54) PROCESS AND DEVICE FOR FOCUSING ACOUSTIC WAVES

(75) Inventors: Mathias Fink, Meudon; Jacques Lewiner, Saint-Cloud, both of (FR)

(73) Assignee: Societe pour les Applications du Retournement Temporel, Suresnes (FR)

( * ) Notice: Subject to any disclaimer, the term of this patent is extended or adjusted under 35 U.S.C. 154(b) by 0 days.

(21) Appl. No.: 09/004,927

(22) Filed: Jan. 9, 1998

Related U.S. Application Data

(63) Continuation of application No. PCT/FR96/01083, filed on Jul. 11, 1996.

(30) Foreign Application Priority Data

Jul. 13, 1995 (FR) ..... 95 08543

(51) Int. Cl.[7] ..... H03B 29/00; A61F 11/06; G10K 11/16

(52) U.S. Cl. ..... 381/71.12; 381/71.1; 381/94.1

(58) Field of Search ..... 381/2, 66, 71.1, 381/71.12, 13, 77, 79, 80, 94.1, 94.2–3, FOR 123, FOR 124; 708/322

(56) References Cited

U.S. PATENT DOCUMENTS

| | | | | |
|---|---|---|---|---|
| 5,092,336 | | 3/1992 | Fink . | |
| 5,267,320 | * | 11/1993 | Fukumizu | 381/71.12 |
| 5,327,496 | | 7/1994 | Russell et al. . | |
| 5,428,999 | | 7/1995 | Fink . | |
| 5,431,053 | | 7/1995 | Fink . | |
| 5,438,624 | | 8/1995 | Lewiner et al. . | |
| 5,699,437 | * | 12/1997 | Finn | 381/71.12 |
| 5,745,580 | * | 4/1998 | Southward et al. | 381/71.1 |

(List continued on next page.)

FOREIGN PATENT DOCUMENTS

WO 94/24662 * 10/1994 (WO) ..... 381/FOR 123

OTHER PUBLICATIONS

A.J. Berkhout et al., "Acoustic Control By Wave Field Synthesis", *The Journal of the Acoustical Society of America,*(vol. No. 5, pp. 2764–2778, May, 1993).

M. Fink et al., "Phase Aberration Correction With Ultrasonic Time Reversal Mirrors, " *Ultrasonics Symposium,*(pp. 1629–1638, Jan. 1, 1994).

C. Prada et al., "The Iterative Time Reversal Mirror: A Solution to Self–focusing In The Pulse Echo Mode," *The Journal of the Acoustical Society of America,*(vol. No. 2, Part 1, pp. 1119–1129, Aug. 1991).

M. Fink, "Time Reversal of Ultrasonic Fields Part I: Basic Principles," *IEEE Transactions on Ultrasonics Ferroelectrics and Frequency Control,*(vol. No. 5, pp. 555–566, Sep. 1992).

D.R. Dowling, "Phase–conjugate array Focusing in a moving medium," *The Journal of the Acoustical Society of America,* (vol. No. 3, pp. 1716–1718, Sep. 1993).

D.R Dowling et al., "Narrow–band performance of phase–conjugate arrays in dynamic random media, " *Acoustical Society of America, Applied Physics Laboratory, College of Ocean and Fishery Sciences, University of Washington, Seattle, Washington 98105,* (pp. 3257–3277, 1992).

*Primary Examiner*—Vivian Chang
*Assistant Examiner*—Xu Mei
(74) *Attorney, Agent, or Firm*—Christensen O'Connor Johnson Kindness PLLC

(57) ABSTRACT

Public announcements are made in a space using n speakers after having determined the impulse response $h_{ij}(t)$ between a plurality of calibration points j belonging to the space and each speaker i. To transmit an information-bearing acoustic signal S(t) through at least one target area in the space in which announcements are to be made, each speaker i is made to transmit a signal (a), where j is an index representing calibration points in the target area.

11 Claims, 4 Drawing Sheets

U.S. PATENT DOCUMENTS 5,834,647 * 11/1998 Gaudriot et al. ..... 381/73.1
5,910,993 * 6/1999 Aoki et al ..... 381/71.12
5,963,651 * 10/1999 Van Veen et al. ..... 381/71.12
5,978,489 * 11/1999 Wau ..... 381/71.12

* cited by examiner

PROCESS AND DEVICE FOR FOCUSING ACOUSTIC WAVES

This is a continuation of International Application PCT/FR96/01083, with an international filing date of Jul. 11, 1996, and a priority date of Jul. 13, 1995, based on French Application 95/08.543. The International Application is expressly incorporated by reference herein.

FIELD OF THE INVENTION

The present invention relates to processes and devices for focusing acoustic waves.

According to a first aspect, the invention relates more particularly to a process for sound-sweeping a space which disturbs the propagation of acoustic waves so as to transmit in this space information in the form of acoustic waves by means of a number n of loudspeakers, n being a natural integer at least equal to 1, this process including sound-sweeping steps in the course of which at least one acoustic signal S(t) carrying information is transmitted in at least one zone, termed a "target zone," which belongs to the space to be sound-swept, this transmission being carried out by having acoustic signals $s_i(t)$ emitted by at least one subset of so-called "active" loudspeakers, which subset includes at least one loudspeaker chosen from among the n above-mentioned loudspeakers.

BACKGROUND OF THE INVENTION

Numerous examples of spaces which disturb the propagation of acoustic waves are known. Among other examples there may be mentioned:

- railway stations and air terminals, or more generally public places in which multiple reflections of sound waves make it difficult to understand the broadcast sound messages intended for users,
- and the spaces in which multi-scattering media would be arranged at least locally, that is to say media in which are dispersed or distributed elements which reflect or individually scatter the acoustic waves, with weak absorption, of a nature such as to cause a spreading of at least one order of magnitude of the duration of an acoustic pulse.

The objective of the present invention is in particular to optimize the transmission of information inside such a space.

SUMMARY OF THE INVENTION

To this end, according to the invention, a process of the kind in question is essentially characterized in that in the course of each sound-sweeping step, each active loudspeaker i emits a signal $$s_i(t) = \sum_j a_j \cdot h_{ij}(-t) \otimes S(t), \tag{1}$$

where:

- $h_{ij}$ (−t) represents the temporal inversion of the impulse response $h_{ij}$ (t), previously determined and stored, between loudspeaker i and a predetermined so-called "calibration" point j belonging to the target zone, the target zone comprising a number p of calibration points, p being a natural integer at least equal to 1, the impulse response $h_{ij}$ (t) corresponding to the acoustic signal received at the point j when loudspeaker i emits a short acoustic pulse,

- and the coefficients $a_j$ are predetermined weighting coefficients.

By virtue of these arrangements, which allow acoustic focusing toward the target zone, the information transmitted in the form of acoustic waves is received perfectly clearly in the target zone, and much less clearly outside the target zone, this presenting no drawback and possibly even constituting an important advantage insofar as the target zone is chosen suitably.

In preferred embodiments of the first aspect of the invention, one and/or other of the following arrangements may possibly also be resorted to:

- the weighting coefficients $a_j$ are all equal to 1;
- the subset of active loudspeakers comprises all the loudspeakers of the space to be sound-swept;
- the number p of calibration points of the target zone is at least equal to 2;
- the number n of loudspeakers is at least equal to 2;
- the signal S(t) corresponds at least in part to a sound signal chosen from among the signals representative of the human voice and the signals representative of musical snatches;
- the space to be sound-swept is a place which receives the public, and the signals S(t) correspond at least in part to public information messages;
- in the course of at least certain of the soundsweeping steps, a number q of target zones is simultaneously sound-swept, where q is a natural integer at least equal to 2, each active loudspeaker i then emitting the superposition of q acoustic signals $$s_{i,k}(t) = \sum_j a_j \cdot h_{ij}(-t) \otimes S_k(t), \tag{2}$$

- where k is a natural integer lying between 1 and q corresponding to each target zone, $S_k(t)$ representing the information-carrying acoustic signal intended to be broadcast in the target zone of index k: use is thus made of the above-mentioned property of the process according to the invention, according to which each signal $S_k(t)$ is perfectly received in the target zone k, but very poorly received, or not received at all, in the other target zones;
- the target zone considered in at least certain of the sound-sweeping steps is as restricted a zone as possible comprising at least one calibration point and in which there is at least one person who is the destination of a voice message represented by the signal S(t).

Moreover, the first aspect of the invention also has as subject a device for implementing a process as defined above, for sound-sweeping a space which disturbs the propagation of acoustic waves, this device including:

- a number n of loudspeakers distributed inside the said space, n being a natural integer at least equal to 1,
- at least one input pathway for receiving a signal S(t) carrying information to be transmitted in the form of acoustic waves in at least one zone, termed the target zone, which belongs to the space to be sound-swept, this transmission being carried out by having acoustic signals $s_i(t)$ emitted by at least one subset of so-called active loudspeakers, which subset includes at least one loudspeaker chosen from among the n above-mentioned loudspeakers,
- a signal processing system for determining each signal $s_i^h(t)$ via the formula:

$$s_i(t) = \sum_j a_j \cdot h_{ij}(-t) \otimes S(t), \quad (3)$$

where $h_{ij}(-t)$ represents the temporal inversion of the impulse response $h_{ij}(t)$, previously determined and stored, between an active loudspeaker i and a predetermined so-called "calibration" point j belonging to the target zone, the target zone comprising a number p of calibration points, p being a natural integer at least equal to 1, and the impulse response $h_{ij}(t)$ corresponding to the acoustic signal received at the point j when loudspeaker i emits a short acoustic pulse, and the coefficients $a_j$ are predetermined weighting coefficients, the signal processing system being linked to the input pathway so as to receive the signal S(t) and to the various loudspeakers so as to transmit respectively thereto the signals $s_i(t)$.

Advantageously, this device furthermore includes means for selecting the target zone within the space to be sound-swept.

According to a second aspect, the subject of the present invention is a process and a device for focusing and temporal compression of acoustic energy. The term "acoustic" should be taken in a general sense, without limiting it to the audible frequencies. It may even be applied to radio waves, insofar as they have a mode of propagation which is akin to that of acoustic waves.

The invention is applicable in numerous fields of the art, among which may be mentioned the following.

The invention makes it possible to concentrate acoustic energy into a given location. This location may for example be that of a fixed target which it is sought to locate or destroy. The latter case is that of lithotrity or the destruction of a tumor in the body. It is also that of the destruction of an explosive contraption, such as a mine.

The location (or a set of such locations) can even be situated on a manufacturing line where objects each of which is to receive one or more intense, brief and localized pulses of acoustic energy are presented in succession.

It also allows communication between a station and a receiver placed at the location at which the energy is concentrated, with discretion ensured by the selective character of the energy concentration; several receivers may be provided, at the cost of an energy distribution.

Processes are already known for examining a medium so as to pinpoint therein reflecting targets and/or for destroying the targets, using the temporal reversal of the signals received by the piezoelectric transducers of a network, before re-emission (document EP-A-0 383 650).

Such processes perform a focusing of energy on a target, that is to say a spatial compression of energy.

The present invention is aimed in particular at carrying out, in addition to spatial compression by focusing, temporal compression of energy.

With this objective, the invention proposes in particular a process according to which:

a) the emission is effected, from the location where it is desired to concentrate the energy, of a short acoustic pulse, having a first duration, b) the acoustic signals coming from the said location through a multi-scattering medium are gathered on a network of transducers and are recorded, for a second duration which is greater by at least one order of magnitude than the first duration; and c) return signals derived from signals gathered by temporal inversion and amplification are emitted toward the multi-scattering medium, from the said transducers.

In general, in the course of step a), a pulse will be sought of duration less than ten periods and preferably five, of the fundamental period in the case of resonant transducers.

The second duration is chosen so as to correspond to the spreading of the time of arrival of the acoustic energy having traversed the multi-scattering medium via all the possible paths within this medium, at least for as long as the transmitted energy remains appreciable.

By "multi-scattering medium" is understood a medium deliberately placed between the target location and the network of transducers, and in which are dispersed or distributed elements which reflect or individually scatter the acoustic energy, with weak absorption, of a nature such as to cause a spreading of at least one order of magnitude of the duration of the initial pulse. In the case of a quasi-random distribution of elements within the volume of the propagation medium, the nature of such a multi-scattering medium can be defined by the mean free path l of the acoustic waves within this medium, that is to say by the distance over which an incoming initial plane wave completely loses the memory of its initial direction. This mean free path l is equal to $1/n\sigma$ where n is the volume density of the scattering elements and where a is their scattering cross section. The free path is all the smaller the larger is $\sigma$, this being obtained when the frequency of the acoustic waves is close to the frequencies of resonance of the elements. These elements may be of very diverse natures. They may in particular be rods, flakes, beads, bubbles of gas, reflecting particles. Typically, the mean dimension a of the particles is such that $2\pi a/\lambda$ is of the order of unity, $\lambda$ being the wavelength of the acoustic waves emitted, or the wavelength corresponding to the center frequency of the spectrum emitted.

When seeking a large spreading of the duration of a pulse and a high compression factor, the thickness e of such a medium (length occupied between the target location and the network) must be greater than the mean free path; a thickness of at least five times is often desirable.

The reflecting elements of the multi-scattering medium may also be distributed at the periphery of the propagation medium. They may in particular consist of discontinuities of impedance between the propagation medium and the outside medium. The multi-scattering medium then includes an acoustic channel between the location of concentration of the waves and the transducers, the walls of which produce, through multiple reflections, the temporal spreading of the initial pulse and the bunching of the return waves.

In the course of step b), recording is performed during a time window which, especially when an acoustic signal is liable to come from several distinct locations, is chosen as a function of the selected location and of the nature of the medium.

It may also be remarked that by giving the multi-scattering medium an angular aperture, viewed from the location of concentration, markedly greater than the angular aperture of the network, a much finer resolution of the refocusing spot than in the case of a homogeneous medium is also obtained. The scattering medium acts, after temporal reversal, like an emitter whose angular aperture, viewed from the location, may be much greater than the angular aperture from which the network is viewed.

The principle implemented by the invention stems from the foregoing. The acoustic return signals (step c) above) travel through the scattering medium along paths which are the reverse of those traveled earlier, insofar as the medium does not alter or alters only very slowly (typically with displacements of the scatterers not producing a modification of the length of the multiple scattering paths of more than 1/10 of the smallest wavelength for which the spectrum emitted exhibits appreciable power) on account of the principle of reversal. The re-emitted acoustic wave undergoes all the scatterings and/or multiple reflections in a time sequence which is the reverse of that of the outward journey and re-forms at the output of the medium the initial acoustic wave, consisting of a short pulse.

When the multi-scattering medium is, totally or partially, surrounded by reflecting surfaces in respect of the waves, all of the re-emitted energy is concentrated onto the chosen location for the duration of the initial pulse, and a much larger gain is obtained than the conventional antenna gain due to focusing, since it is multiplied by a temporal compression factor. Even with transducers of low power or amplifiers with low gain, it is possible to concentrate high powers when the multi-scattering medium causes a substantial lengthening, which may be of the order of 100 and more.

Another aspect of the invention relates to a device for focusing and temporal compression of acoustic energy into one location, including:

- means for causing the emission of a brief acoustic pulse from the said location;
- a network of transducers;
- a multi-scattering medium intended to be interposed between the network of transducers and the said location, and devised so as to temporally spread the said acoustic pulse in such a way as to increase its duration by at least one order of magnitude at the level of the network of transducers,
- the network of transducers being controlled so as to emit acoustic signals obtained by temporal inversion and amplification of acoustic signals picked up in response to the emission of the said pulse.

BRIEF DESCRIPTION OF THE DRAWINGS

Other characteristics and advantages of the first aspect of the invention will emerge in the course of the following detailed description of one of its embodiments, given by way of non-limiting example and in conjunction with the appended drawings.

Figure 4:
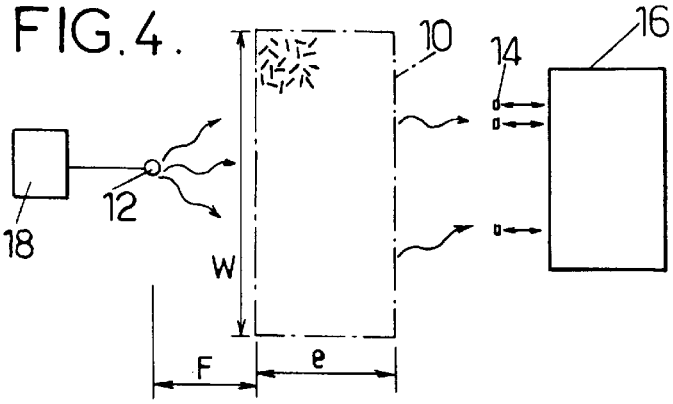
Figure 5:
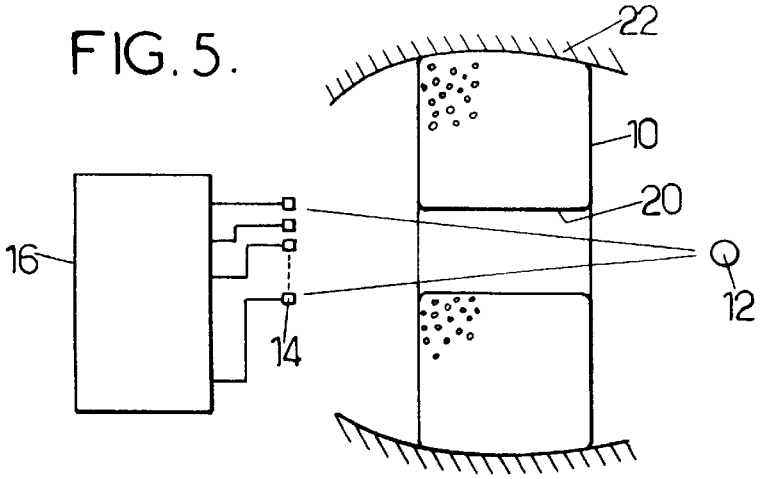
Figure 6A:
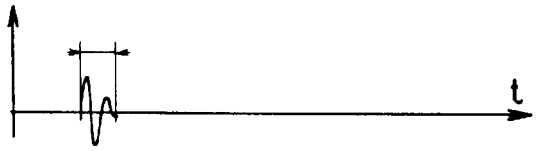
Figure 6B:
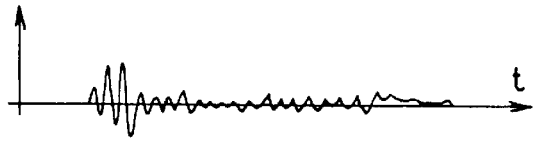
Figure 6C:
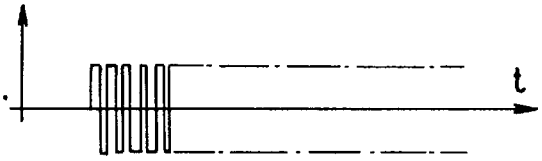

Moreover, the characteristics set out above in respect of the second aspect of the invention, as well as others, will become more apparent on reading the following description of particular embodiments of this second aspect of the invention, which are given by way of non-limiting examples. The description of this second aspect of the invention relates to the drawings which accompany it, in which:

FIG. 4 is a basic diagram showing the conditions of a trial intended to prove the feasibility of the process;

FIG. 5 is a diagram of a first embodiment;

FIGS. 6A to 6C show the shape of the acoustic signals; and

Figure 7:
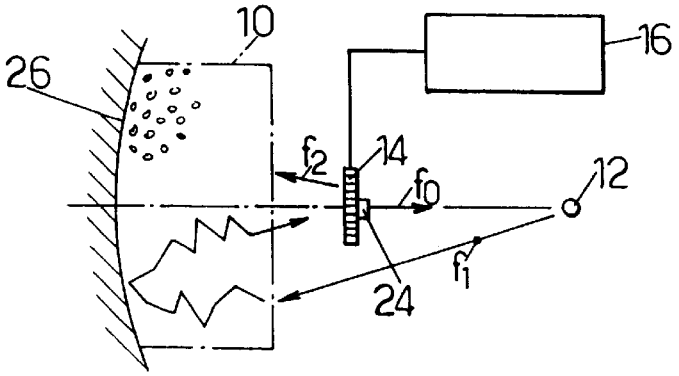
Figure 8:
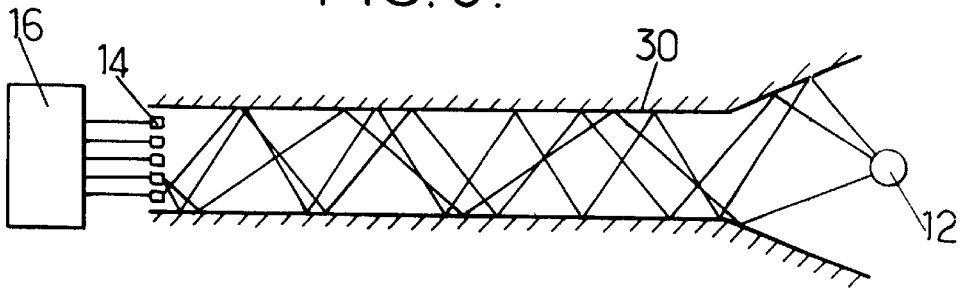
Figure 9:
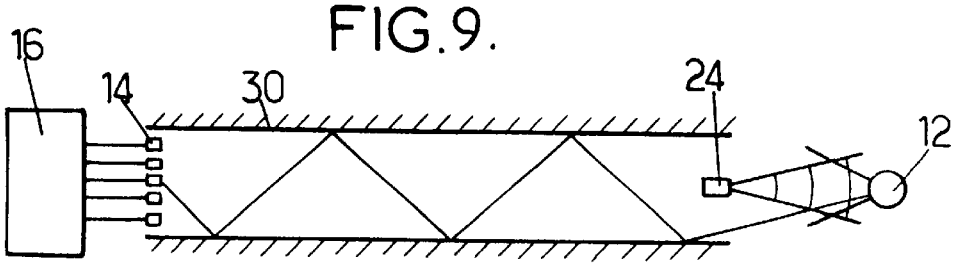

FIGS. 7 to 9 show three variant embodiments.

DETAILED DESCRIPTION

First Aspect of the Invention

Figure 1:
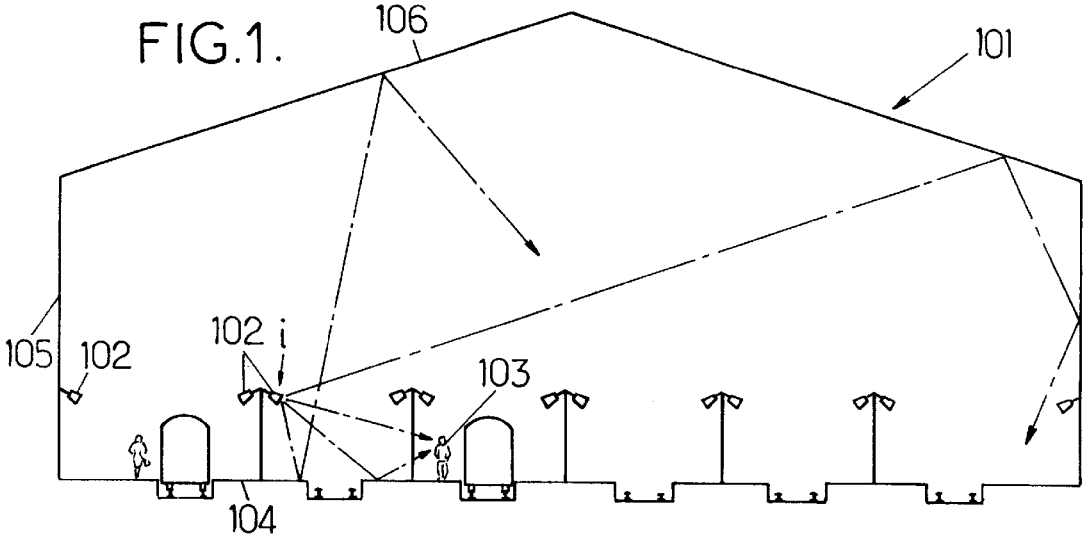
FIG. 1 is a cutaway view of a railway station in which the process according to the first aspect of the invention can be implemented.
Figure 2:
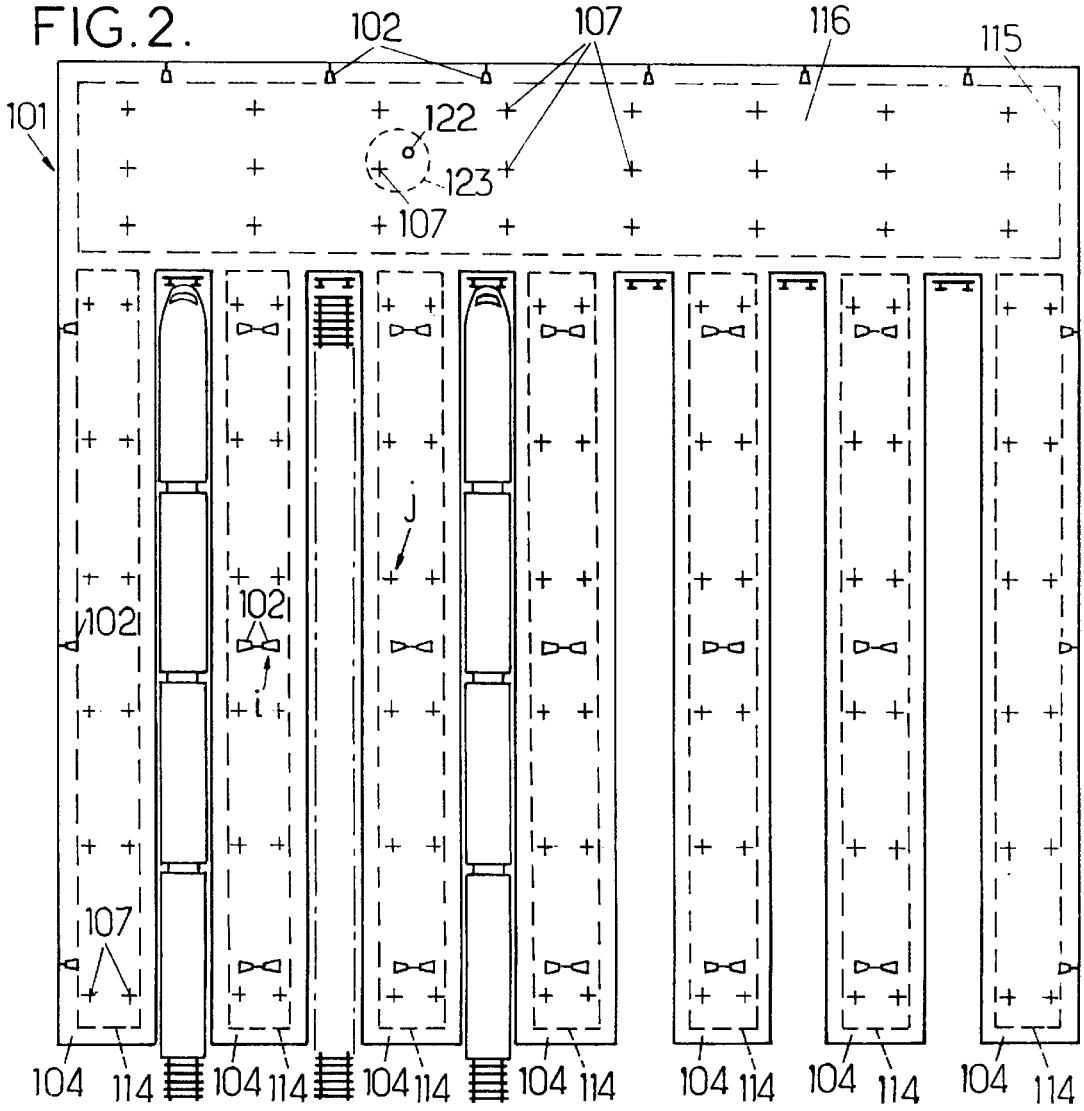
FIG. 2 is a plan view of the railway station of FIG. 1.
Figure 3:
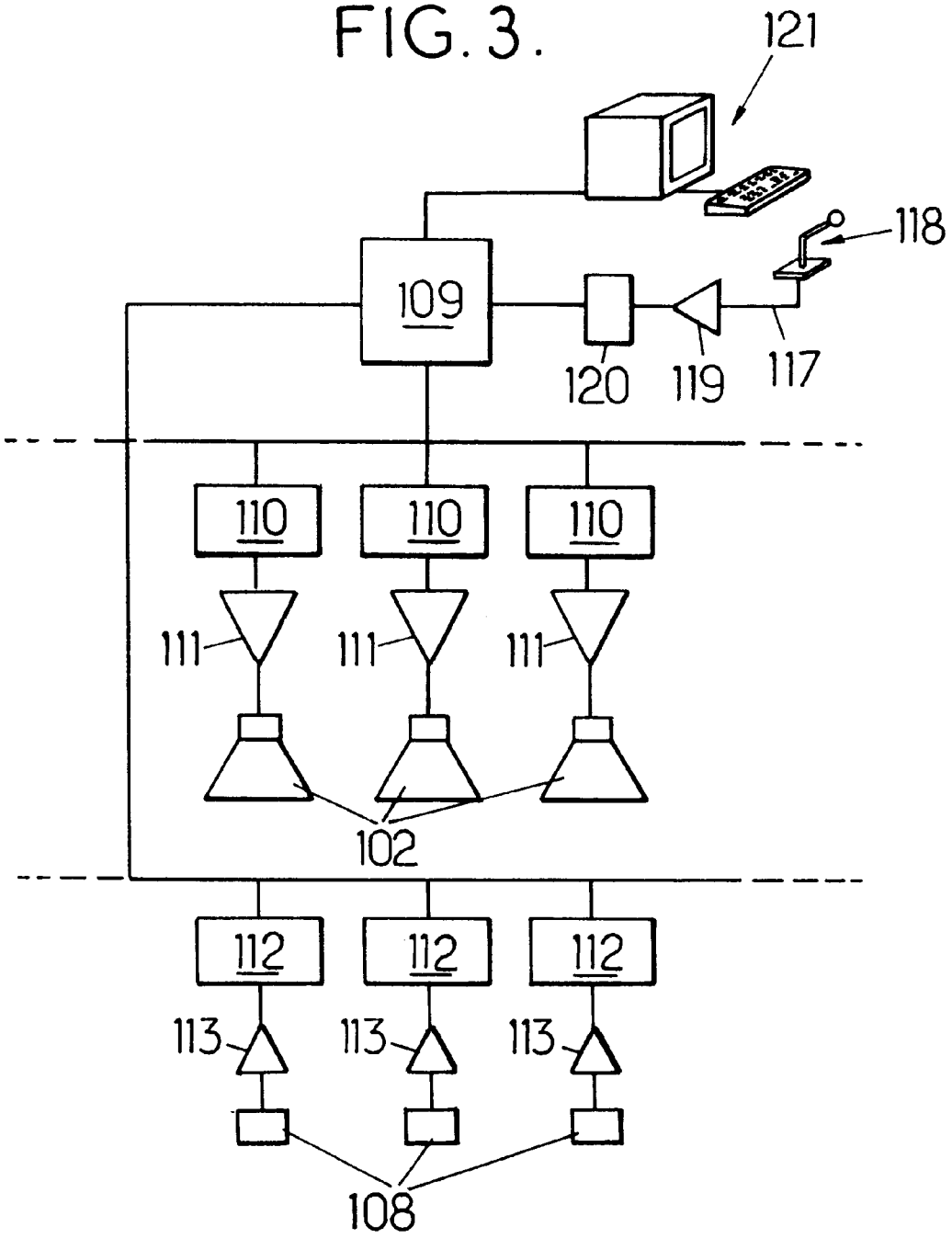
FIG. 3 is a partial diagrammatic view showing an example of a device for implementing the process according to the first aspect of the invention.

In the example represented in FIGS. 1 to 3 in order to illustrate the first aspect of the invention, the space to be sound-swept is a railway station 101 equipped with a large number n of loudspeakers 102, n being a natural integer for example greater than 10.

When the loudspeakers 102 emit a sound signal, for example an information message intended for the passengers 103, the sound waves which result therefrom reach the passengers 103 with significant distortions which are due to the fact that these sound waves undergo multiple paths and consequently arrive in an incoherent manner at the ears of the passengers 103.

The multiple paths in question followed by the sound waves are due to the fact that:

- on the one hand each passenger 103 receives sound waves emitted by several loudspeakers 102 situated at different distances from one another with respect to him,
- and on the other hand, the sound waves emitted by each loudspeaker 102 arrive at the passengers 103 not only along a direct path, but also along multiple indirect paths after one or more reflections on obstacles such as for example the platforms 104, the walls 105 or the roof 106 of the station.

As a result the information message, or any other sound signal emitted by the loudspeakers, is often rather incomprehensible to the passengers 103.

In order to alleviate this drawback, according to the invention, an operation of acoustic "calibration" of the station 101 is firstly carried out, by determining the impulse response $h_{ij}(t)$ between each loudspeaker i and each point j forming part of a set of predetermined so-called "calibration" points 107 distributed inside the station 1.

The calibration points 107 are preferably situated substantially at human height, for example at a height of between 1.5 m and 1.75 m above ground, and they are distributed in the various parts of the station 101 which are frequented by the passengers 103.

The impulse response $h_{ij}(t)$ corresponds to the acoustic signal received at point j when loudspeaker i emits a short acoustic pulse (ideally a Dirac pulse) or conversely to the acoustic signal received at the level of loudspeaker i when a short acoustic pulse is emitted at the level of point j (the impulse response is the same in both directions of propagation).

These impulse responses can therefore be measured relatively simply, preferably at night or at the very least at a time when the station 101 is not receiving the public, by having each loudspeaker 102 in succession emit a short acoustic pulse, and by measuring the acoustic signals received following this pulse at the level of the various calibration points 107, by means of microphones 108 (FIG. 3) previously arranged at the calibration points 107.

In the particular example represented in FIG. 3, each loudspeaker 102 receives in succession from a computer 109 the pulsed signal to be emitted, the computer 109 being linked, for example by a bus link, to a plurality of digital/analog converters 110, each of these digital/analog converters being linked to a loudspeaker 102 by way of an amplifier 111, and each of these digital/analog converters 110 being addressable and controlled independently by the computer 109, so that each loudspeaker 102 can emit a signal independent of the other loudspeakers.

Moreover, the various microphones 108 situated at the level of the calibration points 107 are each linked to an analog/digital converter 112 by way of an amplifier 113, the converters 112 possibly being for example addressable converters linked by bus to the computer 109, so that the signals picked up by the microphones 108 can be stored by the computer 109 for each calibration point 107.

The impulse responses $h_{ij}(t)$ thus stored by the computer 109 are next temporally inverted by this computer, which finally stores the temporal inversions of the impulse responses $h_{ij}(-t)$.

Once the calibration operation has terminated, the various microphones 108 together with their converters 112 and their amplifiers 113 are dismantled.

Subsequently, each time it is necessary to sound-sweep one or more target zones belonging to the station 101, for example a target zone 114 corresponding to a particular platform 104 and/or a target zone 115 corresponding to all or part of the station concourse 116, each loudspeaker i of the station is made to emit a sound signal $$s_i(t) = \sum_j a_j \cdot h_{ij}(-t) \otimes S(t), \tag{4}$$

where:

the indices j correspond to the indices of the calibration points belonging to the target zone or to the target zones considered, each target zone comprising at least one calibration point 107 and preferably several, $a_j$ represents a predetermined weighting coefficient which may possibly be used to favor certain calibration points 107 corresponding to zones heavily frequented by the public, it being possible for these weighting coefficients usually to be all mutually equal and generally all equal to 1, S(t) corresponds to an information-carrying signal, this signal possibly being an information message intended for the passengers, background music, the retransmission of a radio broadcast program, or the like, and the sign $\oplus$ represents the convolution product.

It is recalled here that the convolution product of a function f(t) and a function g(t) is equal to:

$$f(t) \otimes g(t) = \int_{-\infty}^{+\infty} f(t)g(t-\tau)\,d\tau \tag{5}$$

The broadcasting of the sound signal S(t) is carried out by means of the computer 109, which receives the signal S(t) by way of at least one input pathway 117 which includes for example a microphone 118 or another source which sends the signal S(t) to the computer, an amplifier 119 and an analog/digital converter 120.

The computer 109 is linked moreover to an interface 121 comprising for example a keyboard and a screen which enables an operator to choose the target zone 114, 115 in which he wishes to broadcast a message or some other sound signal.

After having selected the desired target zone or zones by means of the interface 121, the operator can then for example speak into the microphone 118 so as to broadcast a message in this target zone: this message S(t) is received by the computer 109, which calculates the signals $s_i(t)$ which each loudspeaker 102 is to be made to emit and transmits these signals to the corresponding loudspeakers 102 by way of the digital/ analog converters 110 and the amplifiers 111.

Optionally, it would be possible to have the signals $s_i(t)$ emitted by only some of the loudspeakers of the station 101, referred to as the active loudspeakers, for example the loudspeakers nearest to the target zone.

As the case may be, it would even be possible to sound-sweep several target zones simultaneously by sending different information-carrying acoustic signals sk(t) into the various respective target zones.

In this case, each active loudspeaker, that is to say in general each loudspeaker of the station 101, emits an acoustic signal $$s_{i,k}(t) = \sum_j a_j \cdot h_{ij}(-t) \otimes S_k(t), \tag{6}$$

As the case may be, the process according to the invention can also be used to send a particularly clear and possibly particularly loud message to a given individual 122 (FIG. 2) or to a given group of individuals.

This may for example be a service message intended for a particular employee, or else a deterrent message intended for an individual who is committing an offense or doing something foolish.

For this purpose, the operator pinpoints the position of the individual 122 or the group of individuals to whom the message is intended, this pinpointing possibly being performed by direct vision or else indirectly by viewing one or more monitor screens linked to one or more surveillance cameras.

This pinpointing being performed, the operator indicates the position of the individual 122 to the computer 109 by way of the interface 121, after which the computer 109 automatically determines a target zone 123 of restricted size, containing the individual 122 and at least one calibration point 107, and then the operator broadcasts his deterrent message to the individual 122.

As is self-evident, and as results moreover from the foregoing, the first aspect of the invention is not limited to the particular embodiment just described; on the contrary it embraces all variants thereof, especially those in which:

the space to be sound-swept is other than a railway station, for example an air terminal, an underground station, a coach station, a swimming pool, a stadium, a beach, a museum (in which case the target zones may correspond to zones situated in the vicinity of the various works of art in one and the same hall, these target zones possibly being demarcated by lines drawn on the ground or the like, and different sound commentaries possibly being broadcast simultaneously in these various target zones respectively), a space belonging to a theme park (in which case the fact of being able to make sounds heard only in certain particular zones of this space can be used in particular as a game), auditoria, and more generally any place which receives the public or else any private place which disturbs the propagation of acoustic waves through multiple reflections or scatterings, the invention is used to listen to a high-fidelity sound program, the target zone then corresponding to a space in which the hearer must position himself in order to listen to the sound program in question, the number n of loudspeakers is less than 10, for example equal to 1 (especially when the space to be sound-swept includes multiple obstacles which are especially good at reverberating the acoustic waves), or equal to 2, the signal S(t) is not an acoustic signal which can be comprehended by the human ear, but a coded signal intended to be received and decoded by an automatic reception device, the acoustic signal S(t) is not a sound signal but an ultrasound or infrasound signal, and the impulse responses $h_{ij}(t)$ are determined otherwise than by having pulsed acoustic signals emitted, for example by having an acoustic signal modulated in a predetermined manner emitted in succession to the various loudspeakers 102, or else by having strings of predetermined acoustic signals emitted to the loudspeakers 102, from which it is possible to deduce the impulse response $h_{ij}(t)$ by computational methods which are known per se, and explained for example in French Patent Application No. 96 05102 of Apr. 23, 1996 in respect of the computation of the impulse responses in the field of radio waves.

Second Aspect of the Invention

In order to bring out the benefit of the second aspect of the invention, the results will firstly be given of trials performed using, as multi-scattering medium, parallel metal rods distributed quasi-randomly and having a diameter of the order of the wavelength λ of the acoustic energy. FIG. 4 shows the multi-scattering medium 10 interposed between a source 12, which constitutes a target situated at a location at which the concentration will be performed, and a network of emitter/receiver transducers 14 linked to a circuit 16 having as many emission/reception pathways as there are transducers. This circuit 16 has a construction of the kind already described in the documents EP-A-0 383 650 and EP-A-0 591 061.

The trials were performed with a target 12 consisting of a hydrophone furnished with an excitation circuit 18 and capable of emitting brief pulses, of 1 microsecond, with a center frequency of 3 MHz. The multi-scattering medium 10 consists of rods 0.5 mm long, with a mean spacing of the order of 2 mm. The thickness e of the medium was 45 mm. The mean free path, for the wavelength considered, was around 1=7 mm. The width w was of the order of 120 mm.

The spherical acoustic wave emitted by the target 12, the emitting part of which had a diameter of the order of 0.5 mm, undergoes multiple scatterings, without noticeable dissipation owing to the reflectivity of the metal. The network of transducers 14 contained 48 transducers and the associated circuit 16 was designed to record the individual signals over durations of around 100 microseconds, corresponding to the spread in the arrival times of the acoustic waves having traversed the multi-scattering medium via all the possible routes.

The circuit 16 included, for each pathway, an analog/digital converter, a memory organized as a queue and means of reading together with reverse time sequencing and amplification.

Measurement of the characteristics of the return wave having traversed the medium 10 has shown that the beam is refocused onto a zone having a width, at −6 dB, substantially equal to λF/w, F being the distance between the exit plane of the multi-scattering medium and the target. This focal spot is finer than it would have been in the absence of the multi-scattering medium. The latter in fact exhibits a much wider angular aperture, viewed from the target, than the network of transducers 14.

The device diagrammatically illustrated in FIG. 5 (in which the items corresponding to those already shown in FIG. 4 are designated by the same reference numeral) is intended to concentrate, onto a passive target 12, a brief and intense pulse, with low-power emission means.

In this case again, a multi-scattering medium 10 is interposed between the network of piezoelectric transducers 14 and the target 12. The transducers 14, or at least some of them, are designed to send to the target 12, which is reflecting, a brief pulse at the frequency of the acoustic waves to be concentrated. It is also possible to use different transducers for the first illumination (step a) above) and for reception and reemission (steps b) and c)). An aperture 20 of sufficient dimension to allow the passage of a brief shot of illumination, without scattering, is made in the multi-scattering medium 10. The illuminated target sends back, to the multi-scattering medium 10 and the network of transducers 14, the wave which is next temporally reversed. The wave received and reflected by the target 12 can have the temporal variation shown diagrammatically in FIG. 6A. This type of signal, having a few fundamental periods and being wideband, can in particular be obtained with the aid of composite technology transducers. The echo signal received by a particular transducer will then have, owing to the fact that part at least of the reflected energy has undergone multi-scattering, a shape which is for example that shown in FIG. 6B.

To reduce the losses of acoustic energy, means such as mirrors 22 can be arranged around the multi-scattering medium 10, in such a way as to reduce the reemissions of acoustic energy toward directions other than that of the target and/or to construct an acoustic channel.

In a simplified variant embodiment, the signal returned by each transducer 14 is not obtained by analog amplification of the reversed signal, but by returning a signal consisting of alternately positive and negative pulses, each having the same duration and the same sign as the corresponding alternation (FIG. 6C).

In the variant embodiment shown in FIG. 4, the multi-scattering medium 10 is placed opposite the target 12 with respect to the network of transducers 14. In this case, the first illumination is performed by an additional emitter 24 (in the direction $f_0$ of FIG. 7). The acoustic energy reflected by the target 12 crosses the medium 10 twice, with an intermediate reflection on a mirror 26, as indicated by the arrow $f_1$. The network 14 also re-emits toward the mirror 26 (arrow $f_2$).

In yet another case, it is sought to concentrate energy in a specified zone in space, constituting a target, which has been selected beforehand. In this case, step a) can be performed only in the course of a gauging phase. Subsequently, the concentration of energy is performed by repeating step c).

This latter mode of execution makes it possible in particular to transmit messages which will be receivable with high power and intelligibly only in a well specified zone. The multi-scattering medium must then be completely stationary.

In this case, if the acoustic wave received in the course of step b) by a transducer i is representable by $e_i(t)$ and the message to be transmitted is of the form s(t), the amplifier provided on the pathway associated with transducer i will be designed so that the emission by the transducer is of the form $e_i(\pi-t)\oplus s(t)$, π being a fixed delay identical for all the transducers. Demodulation will be performed in conventional manner, irrespective of the modulation of the signal s(t).

For underwater transmission, for example from a vessel or an underwater robot, the network of transducers can be aimed away from the target and oriented toward a wall of the underwater acoustic channel, such as the surface or the bottom.

In the variant embodiments of FIGS. 8 and 9, the multi-scattering medium 30 contains no elements distributed randomly within the volume of the propagation medium, but only reflecting elements distributed at its surface, thus defining a channel or acoustic waveguide. The network of transducers 14 is placed at one end of this waveguide.

In the case of FIG. 8, the gauging source 12 is placed at the other end of the waveguide 30. The numerous reflections on the reflecting wall spread the duration of the initial pulse at the level of the network 14, and conversely compress this duration during re-emission focused toward the location initially occupied by the gauging source.

In the case of FIG. 9, a transducer 24 is placed near the end of the waveguide 30 so as to illuminate the reflecting target 12 in the direction away from the guide 30 during the initial step. The transducer 24 can be fixed by means of a mounting which does not hinder the propagation of the waves, such as three wires oriented radially with respect to the axis of the guide, at 120° to one another. That part of the brief illumination beam which is returned by the target 12 to the guide 30 then undergoes the multiple reflections which spread its duration. After temporal reversal and amplification, the energy will be concentrated onto the reflecting target 12 if it has not shifted too far.

Transducers and an associated circuit enabling the processes mentioned above to be implemented will not be described here in a complete manner. Indeed, the construction of the circuits can be similar to that already given in the previously mentioned earlier patent applications. It is only necessary that the memories organized into a queue which are intended to record the complex signal received by the transducers 14 have sufficient capacity. The capacity of these memories will have to be further increased if it is desired to store the wave forms recorded beforehand in relation to several distinct locations, subsequently selectable at will in the re-emission phases. The gain of the amplifiers provided on each pathway of transducers will, for a given power to be concentrated, depend on the temporal spreading produced by the multi-scattering medium 10.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A process for sound-sweeping a space which disturbs the propagation of acoustic waves, so as to transmit in this space information in the form of acoustic waves by means of a number n of loudspeakers, n being a natural integer at least equal to 1, this process including sound-sweeping steps in the course of which at least one acoustic signal S(t) carrying information is transmitted in at least one zone, termed a "target zone," which belongs to the space to be sound-swept, this transmission being carried out by having acoustic signals $s_i(t)$ emitted by at least one subset of so-called active loudspeakers, which subset includes at least one loudspeaker chosen from among the n above-mentioned loudspeakers, which process comprises, in the course of each sound-sweeping step, causing each active loudspeaker i to emit a signal $$s_i(t) = \sum_j a_j \cdot h_{ij}(-t) \otimes S_k(t), ,$$

where:

$h_{ij}(-t)$ represents the temporal inversion of the impulse response $h_{ij}(t)$, previously determined and stored, between loudspeaker i and a predetermined so-called calibration point j belonging to the target zone, the target zone comprising a number p of calibration points, p being a natural integer at least equal to 1, the impulse response $h_{ij}(t)$ corresponding to the acoustic signal received at the point j when loudspeaker i emits a short acoustic pulse, and the coefficients $a_j$ are predetermined weighting coefficients.

2. A process according to claim 1, in which the weighting coefficients $a_j$ are all equal to 1.

3. A process according claim 1, in which the subset of active loudspeakers comprises all the loudspeakers of the space to be sound-swept.

4. A process according to claim 1, in which the number p of calibration points of the target zone is at least equal to 2.

5. A process according to claim 1, in which the number n of loudspeakers is at least equal to 2.

6. A process according to claim 5, in which the space to be sound-swept is a place which receives the public, and the signals S(t) correspond at least in part to public information messages.

7. A process according to claim 1, in which the signal S(t) corresponds at least in part to a sound signal chosen from among the signals representative of the human voice and the signals representative of musical snatches.

8. A process according to claim 7, in which, in the course of at least certain of the sound-sweeping steps, a number q of target zones is simultaneously sound-swept, where q is a natural integer at least equal to 2, each active loudspeaker i then emitting the superposition of q acoustic signals $$s_{i,k}(t) = \sum_j a_j \cdot h_{ij}(-t) \otimes S_k(t),$$

where k is a natural integer lying between 1 and q corresponding to each target zone, $S_k(t)$ representing the information-carrying acoustic signal intended to be broadcast in the target zone of index k.

9. A process according to claim 1, in which the target zone considered in at least certain of the sound-sweeping steps is as restricted a zone as possible comprising at least one calibration point and in which there is at least one person who is the destination of a voice message represented by the signal S(t).

10. A device for implementing a process according to claim 1, for sound-sweeping a space which disturbs the propagation of acoustic waves, said device comprising:

a number n of loudspeakers distributed inside the said space, n being a natural integer at least equal to 1, at least one input pathway for receiving a signal S(t) carrying information to be transmitted in the form of acoustic waves in at least one zone, termed the target zone, which belongs to the space to be sound-swept, this transmission being carried out by having acoustic signals $s_i(t)$ emitted by at least one subset of so-called active loudspeakers, which subset includes at least one loudspeaker chosen from among the n above-mentioned loudspeakers, a signal processing system for determining each signal $s_i^h(t)$ via the formula:

$$s_i(t) = \sum_j a_j \cdot h_{ij}(-t) \otimes S_k(t),$$

where:

$h_{ij}(-t)$ represents the temporal inversion of the impulse response $h_{ij}(t)$, previously determined and stored, between an active loudspeaker i and a predetermined so-called "calibration" point j belonging to the target zone, the target zone comprising a number p of calibration points, p being a natural integer at least equal to 1, and the impulse response $h_{ij}(t)$ corresponding to the acoustic signal received at the point j when loudspeaker i emits a short acoustic pulse, and the coefficients $a_j$ are predetermined weighting coefficients, the signal processing system being linked to the input pathway so as to receive the signal S(t) and to the various loudspeakers so as to transmit respectively thereto the signals $s_i(t)$.

11. A device according to claim 10, furthermore including means for selecting the target zone within the space to be sound-swept.

* * * * *